US008539882B2

(12) United States Patent
Rancourt

(10) Patent No.: US 8,539,882 B2
(45) Date of Patent: Sep. 24, 2013

(54) AUTOMATED PRESS SPEED OPTIMIZATION

(75) Inventor: Michael Raymond Rancourt, Merrimack, NH (US)

(73) Assignee: Goss International Americas, Inc., Durham, NH (US)

( * ) Notice: Subject to any disclaimer, the term of this patent is extended or adjusted under 35 U.S.C. 154(b) by 845 days.

(21) Appl. No.: 12/657,776

(22) Filed: Jan. 27, 2010

(65) Prior Publication Data

US 2011/0179962 A1 Jul. 28, 2011

(51) Int. Cl.
*B41F 33/00* (2006.01)
*B41F 5/16* (2006.01)
*B41F 13/02* (2006.01)

(52) U.S. Cl.
USPC ..... 101/484; 101/178; 101/219

(58) Field of Classification Search
CPC ..... B41F 33/0009; B41F 33/16
USPC ..... 101/484, 483, 219, 156, 178
See application file for complete search history.

(56) References Cited

U.S. PATENT DOCUMENTS

| | | | | |
|---|---|---|---|---|
| 5,083,281 | A * | 1/1992 | Rabindran et al. | 700/220 |
| 5,467,436 | A | 11/1995 | Rodi et al. | 395/114 |
| 5,625,758 | A | 4/1997 | Schneider et al. | 395/114 |
| 5,897,260 | A | 4/1999 | Zingher | 400/719 |
| 6,373,584 | B1 | 4/2002 | Barney et al. | |
| 6,522,422 | B1 | 2/2003 | Klingler et al. | 358/1.15 |
| 6,941,862 | B2 * | 9/2005 | Weiler | 101/227 |
| 7,437,273 | B2 * | 10/2008 | Enke | 702/183 |
| 2006/0005722 | A1 | 1/2006 | Nobukawa et al. | |

FOREIGN PATENT DOCUMENTS

| | | | |
|---|---|---|---|
| CN | 1117919 | A | 3/1996 |
| CN | 1652938 | A | 8/2005 |
| EP | 0649744 | | 4/1995 |
| JP | 2000301700 | A | 10/2000 |
| JP | 2001001500 | A | 1/2001 |

* cited by examiner

*Primary Examiner* — Ren Yan
*Assistant Examiner* — Blake A Tankersley
(74) *Attorney, Agent, or Firm* — Davidson, Davidson & Kappel, LLC

(57) ABSTRACT

A method of operating a web printing press is provided. The method includes storing productivity data, press speeds and paper types of past print jobs run on the web printing press in a database; comparing a paper type of a new print job with the paper types of the past print jobs stored in the database to identify past print jobs with similar or the same paper type as the new print job; selecting a press speed for the new print job based on at least the productivity data of the past print jobs with similar or the same paper type as the new print job; and printing the new print job on the web printing press at the selected press speed.

15 Claims, 1 Drawing Sheet

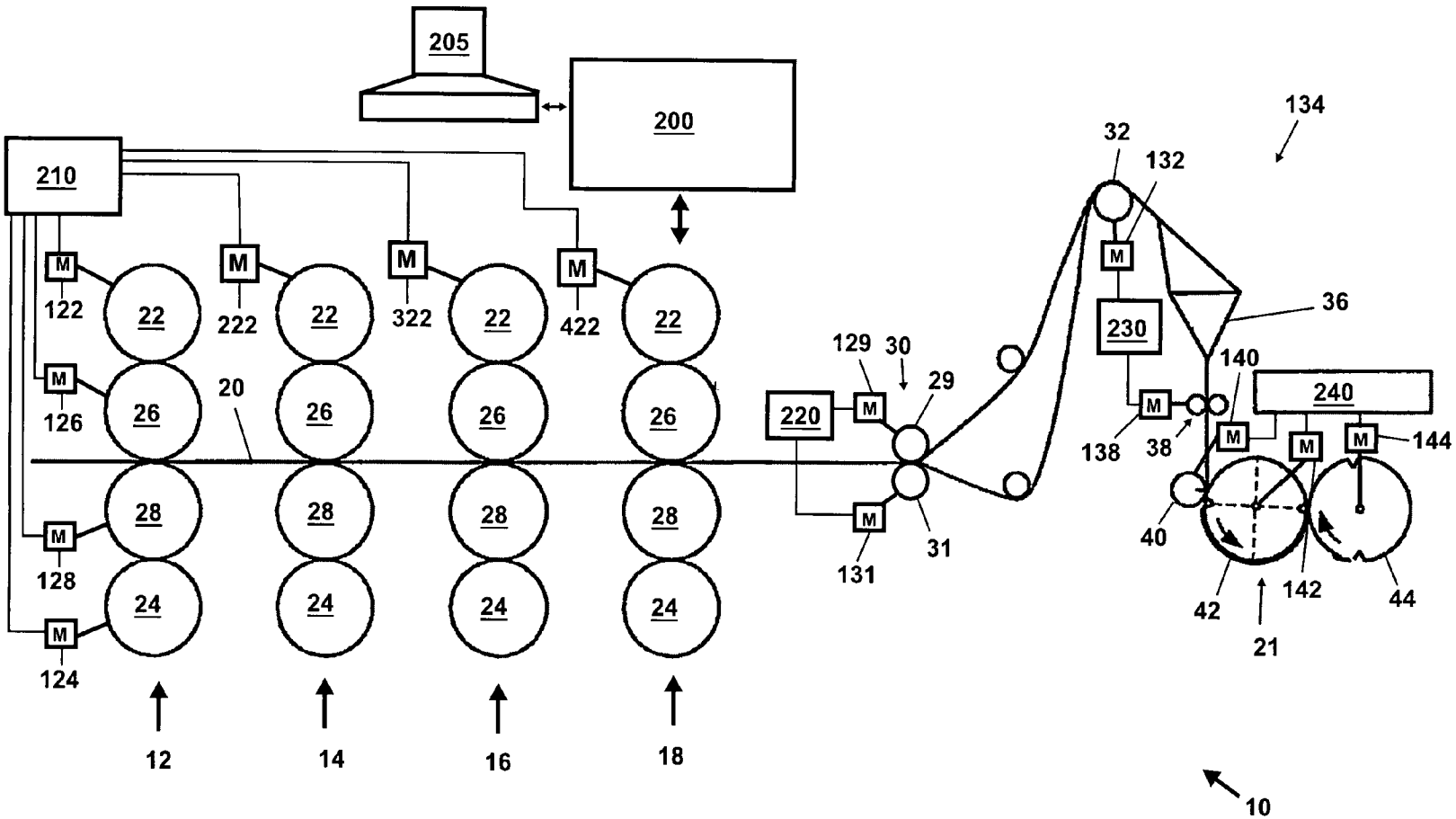
134
36
240
144
44
142
21
10
140
42
132
38
40
32
230
138
29
31
30
129
131
220
200
22
26
28
24
18
422
16
205
322
14
222
20
12
210
122
126
128
124

AUTOMATED PRESS SPEED OPTIMIZATION

The present invention relates generally to web printing presses and more specifically to a method and system for optimizing the speeds web printing presses.

BACKGROUND

Manual means and evaluation of gathered data have been applied to determine press run speeds and production optimization.

BRIEF SUMMARY OF THE INVENTION

A method of operating a web printing press is provided. The method includes storing productivity data, press speeds and paper types of past print jobs run on the web printing press in a database; comparing a paper type of a new print job with the paper types of the past print jobs stored in the database to identify past print jobs with similar or the same paper type as the new print job; selecting a press speed for the new print job based on at least the productivity data of the past print jobs with similar or the same paper type as the new print job; and printing the new print job on the web printing press at the selected press speed.

BRIEF DESCRIPTION OF THE DRAWINGS

The present invention is described below by reference to the following drawing, in which:

FIG. 1 schematically shows a diagram of an offset newspaper web printing press according to an embodiment of the present invention.

DETAILED DESCRIPTION

FIG. 1 schematically shows a diagram of an offset newspaper web printing press 10 according to an embodiment of the present invention. Web printing press 10 may have four printing units 12, 14, 16, 18, which may be, offset lithographic web printing units printing on a web 20 in cyan, magenta, yellow and black, respectively. Each printing unit 12, 14, 16, 18 may include upper and lower plate cylinders 22, 24 equipped with corresponding printing plates and upper and lower blanket cylinders 26, 28 equipped with corresponding printed blankets. Each cylinder 22, 24, 26, 28 of printing units 12 may be driven by a respective individual motor 122, 124, 126, 128. Cylinders 22, 24, 26, 28 of printing units 14, 16, 18 may be driven by motors 222, 322, 422, respectively, or each cylinder 22, 24, 26, 28 of each printing unit 14, 16, 18 may be driven by an individual motor, as in printing unit 12. Motors 122, 124, 126, 128 may be controlled by a controller 210, which may also control motors 222, 322, 422 driving the cylinders 22, 24, 26, 28 of printing units 14, 16, 18.

Web 20 may be slit by a slitter 30 into ribbons which are recombined at a roller 32, which may be driven by a motor 132. Slitter 30 may include a blade 29 and an anvil 31, which may be driven by individual motors 129, 131, which may be controlled by a controller 220. Ribbons of web 20 then enter a folder 134 and are pulled over a former board 36 by draw rollers 38 to fold the ribbons longitudinally. At least one of draw rollers 38 may be driven by a motor 138. Motors 132, 138 may be controlled by a controller 230. A cross cutter 40 of folder 134 may then cut ribbons into signatures, i.e., newspaper pages 21, which are gripped at a lead edge by a collect cylinder 42. Collect cylinder 42 has pins that selectively articulate to release a page 21 for cross-folding, or retain a page to collect with other pages 21. Pages 21 are then tucked and cross-folded into a folding cylinder, for example, jaw cylinder 44. After folding, pages 21 may be released to, for example, a fan wheel. Cross cutter 40, collect cylinder 42 and jaw cylinder 44 may be driven by respective motors 140, 142, 144, which may be controlled by a controller 240. Controller 240 may set the phasing between pins and tuckers of collect cylinder 42, and control the phasing of jaws of jaw cylinder 44, so that a cross-fold distance can be set.

A press control system 200 in wired or wireless communication with controllers 210, 220, 230, 240 may receive operational input data from controllers 210, 220, 230, 240 and may direct the speed at which web printing press 10 is operated by sending commands to controllers 210, 220, 230, 240. Press system 200 controls the operation of components downstream of printing units 12, 14, 16, 18 based on the surface velocities of cylinders 22, 24, 26, 28 of printing units 12, 14, 16, 18. Through communication with controllers 210, 220, 230, 240, press control system 200 may collect running speed data for each component in printing press 10 and direct the speeds that motors 122, 124, 126, 128, 129, 131, 132, 138, 140, 142, 144 operate during each print job. Press control system 200 may be in wired or wireless communication with a human machine interface (HMI) 205, which allows a user to view input data collected by press control system 200.

Motors 122, 124, 126, 128, 129, 131, 132, 138, 140, 142, 144 may each include an internal or external speed sensor that sends measured values to the associated controller 210, 220, 230, 240. In alternative embodiments, the use of controllers may range from each motor 122, 124, 126, 128, 129, 131, 132, 138, 140, 142, 144 being controlled by an individual controller or a single controller, such as for example press control system 200, controlling all of motors 122, 124, 126, 128, 129, 131, 132, 138, 140, 142, 144. The arrangement of controllers 210, 220, 230, 240 of FIG. 1 is merely exemplary.

Press control system 200 works to optimize the printing of print jobs by printing press 10 by taking into account productivity data including a press productivity $P_{prod}$, a press unproductivity $P_{unprod}$ and a press productivity ratio $P_{ratio}$ for printing press 10 for each individual print job. Press productivity $P_{prod}$ for a print job as used herein is calculated by dividing a number of the signatures created that are acceptable for use in final printed products $N_{good}$ (i.e., good count) by a run time $T_{run}$ of the print job ($P_{prod}=N_{good}/T_{run}$). The run time $T_{run}$ of the print job is equal to a total elapsed time of the print job $T_{total}$ minus an amount of time printing press 10 had to be stopped (i.e., press is at zero speed) during the print job for job process corrections and adjustments $T_{stop}$($T_{run}=T_{total}-T_{stop}$). The total time $T_{total}$ equals an end time of the print job $T_{end}$ minus a start time of the print job $T_{start}$($T_{run}=T_{end}-T_{start}$). Press unproductivity $P_{unprod}$ for a print job as used herein is calculated by dividing a number of the signatures that are unacceptable for use in final printed products $N_{waste}$ (i.e., waste count) by the run time $T_{run}$($P_{prod}=N_{waste}/T_{run}$). Press productivity ratio $P_{ratio}$ equals the press productivity $P_{prod}$ divided by the press unproductivity $P_{unprod}$($P_{ratio}=P_{prod}/P_{unprod}$), i.e., good count $N_{good}$ divided by waste count $N_{waste}$ ($P_{ratio}=N_{good}/N_{waste}$).

Before a new print job is run on printing press 10, predetermined print job specifications for the new print job, including the paper type and Job ID for the new print job, may be provided to press control system 200, for example by entering the predetermined job data through HMI 205 or providing the predetermined job data to press control system through a compute readable medium. Press control system 200 includes a data storage that includes measured job data for past print jobs run on printing press 10. In particular, for past print jobs, the data storage includes the paper type, the press productivity $P_{prod}$, the press productivity ratio $P_{ratio}$, the run speed $V_{run}$ and the make ready speed $V_{ready}$. The run speed $V_{run}$ is the speed of printing press 10 during production of printed products and the make ready speed $V_{ready}$ is the speed of printing press 10 for job process corrections and adjustments. For the new print job to be run on printing press 10, a speed optimization algorithm of press control system 200 searches the data storage for past print jobs of the same paper type. If previous jobs of the same paper type are found in the data storage, the speed optimization algorithm retrieves the press productivity $P_{prod}$, the press productivity ratio $P_{ratio}$, the run speed $V_{run}$ and the make ready speed $V_{ready}$ for the previous jobs of the same paper type and identifies the previously run print job for the same paper type that contains the maximum press productivity and the maximum press productivity ratio, i.e., the optimal previous print job.

The speed optimization algorithm of press control system 200 then sets the run speed and the make ready speed for printing press 10 for the new print job to correspond to that of the optimal previous print job. The run speed and the make ready speed for the new print job may not be exactly the same as the optimal previous print job, but may instead be based off of the run speed and the make ready speed of the optimal previous print job plus or minus one or more speed modifier constants. The speed modifier constants may be small incremental modifiers that are configurable to depend on the recent productivity of printing press 10 and the press productivity ratio trends of printing press 10. For example, if print jobs with minimal waste have recently been run at higher speeds than at the time the optimal previous print job was run, then the run speed and make ready speed of the new job may be adjusted upwardly to account for this trend. Conversely, if the speed of printing press 10 has had to be reduced recently to minimize waste, then the run speed and make ready speed of the new job may be adjusted downwardly to account for this trend.

If previous jobs of the same paper type as the new print job are not found in the data storage, press control system 200 may set the run speed and make ready speed of printing press 10 based on default values. Alternatively, the run speed and make ready speed may be set by the operator via HMI 205.

Press control system 200 may measure, for example with sensors at the end of printing press 10, or be provided with data indicating a good count $N_{good}$ for the new print job, a waste count $N_{waste}$ for the new print job and a total number of signatures created by printing press 10 for the new print job $N_{total}$ (i.e., total count) ($N_{total}=N_{good}+N_{waste}$). Additionally, press control system 200 may measure or be provided with a start time of the new print job $T_{start}$, an end time of the new print job $T_{end}$, an amount of time printing press 10 had to be stopped during the new print job for job process corrections and adjustments $T_{stop}$, and an amount of make ready time that it took printing press 10 to restart after being stopped during the new print job $T_{ready}$. This data, along with the run speed $V_{run}$ and the make ready speed $V_{ready}$ of printing press 10 for the new print job, may be used by press control system 200 to calculate the press productivity $P_{prod}$, the press unproductivity $P_{unprod}$, the press productivity ratio $P_{ratio}$ and the job run time $T_{run}$ of printing press 10 during the new print job. Then, the Job ID, the paper type, the press productivity $P_{prod}$, the press unproductivity $P_{unprod}$, the press productivity ratio $P_{ratio}$, the job run time $T_{run}$, the press run speed $V_{run}$ and the make ready speed $V_{ready}$ are stored in the data storage of press control system 200 for use in establishing optimum run conditions of future print jobs of the same paper type.

In a preferred embodiment, press control system 200 may control the operation of printing press 10 during an initial print job based on default parameters, which may be entered by the operator or in another conventional manner. During the initial print job, press control system 200 may monitor the operating parameters of components of printing press 10, for example via communication with controllers 210, 220, 230, 240 and sensors 25, and "learn" the total productivity $P_{total}$ of printing press 10 for the initial print job. Press control system 200 may then store this information in an internal database.

As more print jobs are run on printing press 10, more information is collected by press control system 200. More information is then available to the speed optimization algorithm of press control system 200 to estimate the optimal run speed $V_{run}$ and make ready speed $V_{ready}$ of printing press 10 for a particular print job so press control system 200 direct the operation of motors 122, 124, 126, 128, 129, 131, 132, 138, 140, 142, 144 to achieve an optimum total productivity $P_{total}$ for the particular print job.

In a preferred embodiment, operational risk factors may be introduced into the speed optimization algorithm to take some risk in increasing operating speeds beyond historical set points to probe performances versus risk and operate in ranges where a human operator may not have previously tested (although equipment operating ranges would be respected).

Furthermore the press control system 200 may display information through the HMI 205 to the operator of the printing press 10. This information may be the highest productivity jobs and the associated data of those jobs, the Job ID for the particular print job, the run speeds of each motor 122, 124, 126, 128, 129, 131, 132, 138, 140, 142, 144, the run speed $V_{run}$ of printing press 10, the make ready speed $V_{ready}$ of printing press 10, the total number of signatures $N_{total}$ created for the print job, the number of signatures usable in final printed products $N_{good}$, the number of signatures from the print job that are unusable and wasted $N_{waste}$, the job start time $T_{start}$, the job end time $T_{end}$, the total job duration $T_{total}$, paper type, the maximum speed during job $V_{max}$, the amount of downtime during the print job $T_{stop}$, the downtime reasons and the run duration $T_{run}$. The operator may then use this information to alter the run speed $V_{run}$ of printing press 10 for a print job.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A method of operating a web printing press comprising:

storing productivity data, press speeds and paper types of past print jobs run on the web printing press in a database;

comparing a paper type of a new print job with the paper types of the past print jobs stored in the database to identify past print jobs with similar or the same paper type as the new print job;

selecting a press speed for the new print job based on at least the productivity data of the past print jobs with similar or the same paper type as the new print job; and printing the new print job on the web printing press at the selected press speed.

2. The method recited in claim 1 further comprising storing the productivity data, press speeds and paper type of the new print job in the database.

3. The method recited in claim 1 wherein the selecting step includes selecting the press speed for the new print job based on the productivity data of the past print jobs with the same paper type as the new print job and a speed modifier.

4. The method recited in claim 3 wherein the speed modifier is based on recent productivity of the web printing press.

5. The method recited in claim 3 wherein the speed modifier is based on press productivity ratio trends of the web printing press.

6. The method recited in claim 1 wherein the productivity data is based upon a number of the signatures created during each of the past print jobs that are acceptable for use in final printed products.

7. The method recited in claim 1 wherein the productivity data is based upon the run time of each of the past print jobs.

8. The method recited in claim 1 wherein the productivity data is based upon a number of the signatures created during each of the past print jobs that are unacceptable for use in final printed products.

9. The method recited in claim 1 wherein the productivity data includes a press productivity that is defined as a number of the signatures created during a print job that are acceptable for use in final printed products divided by a run time of the respective print job.

10. The method recited in claim 1 wherein the productivity data includes a press productivity ratio that is defined as a number of the signatures created during a print job that are acceptable for use in final printed products divided by a number of the signatures created during the print job that are unacceptable for use in final printed products.

11. The method as recited in claim 1 wherein the selecting step includes selecting a press speed for the new print job based on at least the press speed of the past print job with similar or the same paper type as the new print job having at least one of a maximum value for a press productivity and a maximum value for a press productivity ratio.

12. The method as recited in claim 1 further comprising retrieving a run speed of the web printing press, a make ready speed of the web printing press, a press productivity and a press productivity ratio for the past print jobs with similar or the same paper type as the new print job after the comparing step.

13. The method as recited in claim 12 wherein the selecting step includes selecting the press speed for the new print job based on the past print job with similar or the same paper type as the new print job having at least one of a maximum value for press productivity and a maximum value for press productivity ratio.

14. The method as recited in claim 13 wherein the printing step includes operating the web printing press using the run speed and the make ready speed of the past print job with similar or the same paper type as the new print job having the at least one of the maximum value for press productivity and the maximum value for press productivity ratio.

15. The method as recited in claim 1 wherein the web printing press includes at least one offset lithographic printing unit and the printing step includes printing the new print job on the web by operating the at least one offset lithographic printing at the selected press speed.

* * * * *